US006134414A

United States Patent [19]

Fujita

[11] Patent Number: 6,134,414

[45] Date of Patent: Oct. 17, 2000

[54] DEVELOPING APPARATUS USING VOLTAGE WAVEFORMS WITH STRAIGHT LINE PORTIONS

[75] Inventor: Tetsumaru Fujita, Amagasaki, Japan

[73] Assignee: Minolta Co., Ltd., Osaka, Japan

[21] Appl. No.: 09/371,524

[22] Filed: Aug. 10, 1999

[30] Foreign Application Priority Data

| | | | |
|---|---|---|---|
| Aug. 10, 1998 | [JP] | Japan | 10-225080 |
| Aug. 10, 1998 | [JP] | Japan | 10-225081 |
| Mar. 1, 1999 | [JP] | Japan | 11-052924 |

[51] Int. Cl.[7] ..... G03G 15/08

[52] U.S. Cl. ..... 399/270; 399/285; 430/120

[58] Field of Search ..... 399/270, 285; 430/120, 122

[56] References Cited

U.S. PATENT DOCUMENTS

| | | | |
|---|---|---|---|
| 4,610,531 | 9/1986 | Hayashi et al. . | |
| 4,688,923 | 8/1987 | Kohyama . | |
| 5,532,801 | 7/1996 | Mizoguchi . | |
| 5,534,982 | 7/1996 | Sakaizawa et al. . | |
| 5,678,130 | 10/1997 | Enomoto et al. | 399/55 |

FOREIGN PATENT DOCUMENTS 8-137222 5/1996 Japan .

*Primary Examiner*—Joan Pendergrass

*Attorney, Agent, or Firm*—Burns, Doane, Swecker & Mathis, LLP

[57] ABSTRACT

A developing apparatus according to the present invention for developing an electrostatic latent image formed on an image carrying member has a developer carrying member arranged opposite to an image carrying member and holding a developer, and a voltage applying device applying an AC voltage to the developer carrying member, wherein the AC voltage has a first peak potential and a second peak potential, the first peak potential being a peak potential on the side of development for supplying the developer to the image carrying member, the second peak potential being a peak potential on the side of recovery for returning the developer to the developer carrying member, and a voltage waveform of the AC voltage always has two straight line portions which differ in slopes while changing from the first peak potential to the second peak potential and/or from the second peak potential to the first peak potential.

25 Claims, 6 Drawing Sheets

DEVELOPING APPARATUS USING VOLTAGE WAVEFORMS WITH STRAIGHT LINE PORTIONS

BACKGROUND OF THE INVENTION

This application is based on applications Nos. 225080/1998, 225081/1998 and 52924/1999 filed in Japan, the contents of which is hereby incorporated by reference 1. Field of the Invention The present invention relates generally to a developing apparatus used for developing an electrostatic latent image formed on an image carrying member in an image forming apparatus such as a copying machine or a printer, and more particularly, to a developing apparatus for conveying a developer held in the surface of the developer carrying member to a developing area opposite to the image carrying member as well as applying an AC voltage to the developer carrying member to perform development, characterized in that the developing characteristics thereof are improved, to obtain an image having a sufficiently image density, and the density of the image can be suitably controlled.

2. Description of the Related Art

In an image forming apparatus such as a copying machine or a printer, various developing apparatuses have been conventionally used for developing an electrostatic latent image formed on an image carrying member.

A developing apparatus shown in FIG. 1 has been known as one of such developing apparatuses.

In the developing apparatus shown in FIG. 1, a magnet member 12 having a plurality of magnetic poles N, S, . . . on the side of the inner periphery of a cylindrical developer carrying member 11 provided opposite to an image carrying member 1 is provided, to mix and agitate a developer 2 containing toners and carriers which are contained in the main body 10 of the apparatus by a developer agitating member 13 and to supply the developer 2 to the developer carrying member 11 by the developer agitating member 13. The developer 2 is held in the surface of the developer carrying member 1 by a magnetic force of the magnet member 12.

The developer carrying member 11 is rotated to convey the developer 2, and the amount of the developer 2 thus conveyed is adjusted by a regulating member 14, to convey the developer 2 in a suitable amount to a developing area opposite to the image carrying member 1 by the developer carrying member 11. A DC voltage is applied to the developer carrying member 11 from a DC power supply 15, and an AC voltage is applied thereto from an AC power supply 16, to exert an electric field which is an overlapping of a DC electric field and an AC electric field on the developing area where the developer carrying member 11 and the image carrying member 1 are opposite to each other. Toners in the developer 2 are supplied to an electrostatic latent image portion formed in the image carrying member 1 from the developer carrying member 11, to perform development.

When the toners in the developer 2 are thus supplied to the electrostatic latent image portion formed in the image carrying member 1 to perform development by applying the DC voltage to the developer carrying member 11 from the DC power supply 15 and applying the AC voltage thereto from the AC power supply 16, the toners in the developer 2 are not suitably supplied in correspondence with a surface potential at the electrostatic latent image portion formed in the image carrying member 1. Accordingly, there are some problems. For example, an image having a sufficient image density cannot be obtained, and the density of a formed image cannot be suitably controlled.

SUMMARY OF THE INVENTION

An object of the present invention is to solve the above-mentioned various problems in a developing apparatus for conveying a developer held in the surface of a developer carrying member to a developing area opposite to an image carrying member and applying an AC voltage between the developer carrying member and the image carrying member to perform development.

A first object of the present invention is to supply, in performing development by applying an AC voltage to a developer carrying member to exert an AC electric field on a developing area where the developer carrying member and an image carrying member are opposite to each other in the above-mentioned manner, a developer in a suitable amount to an electrostatic latent image portion formed in the image carrying member from the developer carrying member in correspondence with a surface potential at the electrostatic latent image portion in the image carrying member, to obtain an image having a sufficient image density.

Another object of the present invention is to make it possible to also suitably control the image density of a formed image in performing development in the above-mentioned manner.

In the present invention, a first developing apparatus for developing an electrostatic latent image formed on an image carrying member comprises a developer carrying member arranged opposite to the image carrying member and holding a developer, and a voltage applying device applying an AC voltage to the developer carrying member, wherein the AC voltage has a first peak potential and a second peak potential, the first peak potential being a peak potential on the side of development for supplying the developer to the image carrying member, the second peak potential being a peak potential on the side of recovery for returning the developer to the developer carrying member, and a voltage waveform of the AC voltage always comprises a first straight line portion and a second straight line portion while changing from the first peak potential to the second peak potential, the first straight line portion and the second straight line portion differing in slopes.

In the present invention, a second developing apparatus for developing an electrostatic latent image formed on an image carrying member comprises a developer carrying member arranged opposite to the image carrying member and holding a developer, and a voltage applying device applying an AC voltage to the developer carrying member, wherein the AC voltage has a first peak potential and a second peak potential, the first peak potential being a peak potential on the side of development for supplying the developer to the image carrying member, the second peak potential being a peak potential on the side of recovery for returning the developer to the developer carrying member, and a voltage waveform of the AC voltage always comprises a third straight line portion and a fourth straight line portion while changing from the second peak potential to the first peak potential, the third straight line portion and the fourth straight line portion differing in slopes.

In the present invention, a third developing apparatus for developing an electrostatic latent image formed on an image carrying member comprises a developer carrying member arranged opposite to the image carrying member and holding a developer, and a voltage applying device applying an AC voltage to the developer carrying member, wherein the AC voltage has a first peak potential and a second peak potential, the first peak potential being a peak potential on the side of development for supplying the developer to the image carrying member, the second peak potential being a peak potential on the side of recovery for returning the developer to the developer carrying member, a voltage waveform of the AC voltage always comprises a first straight line portion and a second straight line portion while changing from the first peak potential to the second peak potential, the first straight line portion and the second straight line portion differing in slopes, and the voltage waveform always comprises a third straight line portion and a fourth straight line portion while changing from the second peak potential to the first peak potential, the third straight line portion and the fourth straight line portion differing in slopes.

As in the developing apparatus according to the present invention, when the AC voltage applied to the developer carrying member is provided with at least two straight line portions the respective voltage waveforms of which differ in slopes while changing from the peak potential on the side of development (the first peak potential) for supplying the developer to the image carrying member to the peak potential on the side of recovery (the second peak potential) for returning the developer to the developer carrying member and/or from the peak potential on the side of recovery (the second peak potential) for returning the developer to the developer carrying member to the peak potential on the side of development (the first peak potential) for supplying the developer to the image carrying member, the movement of the developer between the developer carrying member and the image carrying member is satisfactorily controlled. Consequently, the developing performance is improved, thereby obtaining an image having a sufficient image density. Further, the developer in a suitable amount corresponding to a surface potential at an electrostatic latent image portion formed in the image carrying member is satisfactorily supplied, thereby making it possible to also suitably control the density of the image.

Consider a case where the AC voltage changes from the peak potential on the side of development (the first peak potential) for supplying the developer to the image carrying member to the peak potential on the side of recovery (the second peak potential) for returning the developer to the developer carrying member through the first straight line portion whose voltage waveform has a gentle slope and the second straight line portion whose voltage waveform has a steeper slope than the first straight line portion. In this case, when a time period during which the first peak potential is exerted and a time period during which the second peak potential is exerted are the same, the developing performance is further improved, to obtain an image having a sufficient image density, and the density of the image can be suitably controlled in a case where the time period T1 during which the first or second peak potential is exerted and a time period T2 in the first straight line portion whose voltage waveform has a gentle slope satisfy the condition of $0.2 \leqq T2/T1 \leqq 3$ and in a case where a peak-to-peak value Vpp of the AC voltage, a first peak potential V1, and a potential V2 at which the AC voltage changes from the first straight line portion to the second straight line portion satisfy the condition of $0.2 \leqq |V1-V2|/Vpp \leqq 0.7$.

Consider a case where the AC voltage changes from the peak potential on the side of recovery (the second peak potential) for returning the developer to the developer carrying member to the peak potential on the side of development (the first peak potential) for supplying the developer to the image carrying member through the third straight line portion whose voltage waveform has a gentle slope and the fourth straight line portion whose voltage waveform has a steeper slope than the third straight line portion. In this case, when a time period during which the first peak potential is exerted and a time period during which the second peak potential is exerted are the same, the developing performance is further improved, to obtain an image having a sufficient image density, and the density of the image can be suitably controlled in a case where the time period T1 during which the first or second peak potential is exerted and a time period T2 in the third straight line portion whose voltage waveform has a gentle slope satisfy the condition of $0.2 \leqq T2/T1 \leqq 3$ and in a case where a peak-to-peak value Vpp of the AC voltage, a first peak potential V1, and a potential V2 at which the AC voltage changes from the first straight line portion to the second straight line portion satisfy the condition of $0.3 \leqq |V1-V2|/Vpp \leqq 0.8$.

Consider a case where the AC voltage changes from the peak potential on the side of development (the first peak potential) for supplying the developer to the image carrying member to the peak potential on the side of recovery (the second peak potential) for returning the developer to the developer carrying member through the first straight line portion whose voltage waveform has a gentle slope and the second straight line portion whose voltage waveform has a steeper slope than the first straight line portion, and a case where the AC voltage changes from the peak potential on the side of recovery (the second peak potential) for returning the developer to the developer carrying member to the peak potential on the side of development (the first peak potential) for supplying the developer to the image carrying member through the third straight line portion whose voltage waveform has a gentle slope and the fourth straight line portion whose voltage waveform has a steeper slope than the third straight line portion. In this case, when a time period during which the first peak potential is exerted and a time period during which the second peak potential is exerted are the same, the developing performance is further improved, to obtain an image having a sufficient image density, and the density of the image can be suitably controlled in a case where the time period T1 during which the first or second peak potential is exerted and a time period T2 in the first straight line portion satisfy the condition of $0.2 \leqq T2/T1 \leqq 3$ and in a case where a peak-to-peak value Vpp of the AC voltage, a first peak potential V1, and a potential V2 at which the AC voltage changes from the first straight line portion to the second straight line portion satisfy the condition of $0.2 \leqq |V1-V2|/Vpp \leqq 0.9$.

There and other objects, advantages and features of the invention will become apparent from the following description thereof taken in conjunction with the accompanying drawings which illustrate specific embodiment of the invention.

DESCRIPTION OF THE PREFERRED EMBODIMENTS

A preferred embodiment of a developing apparatus in the present invention will be specifically described on the basis of the accompanying drawings.

Figure 1:
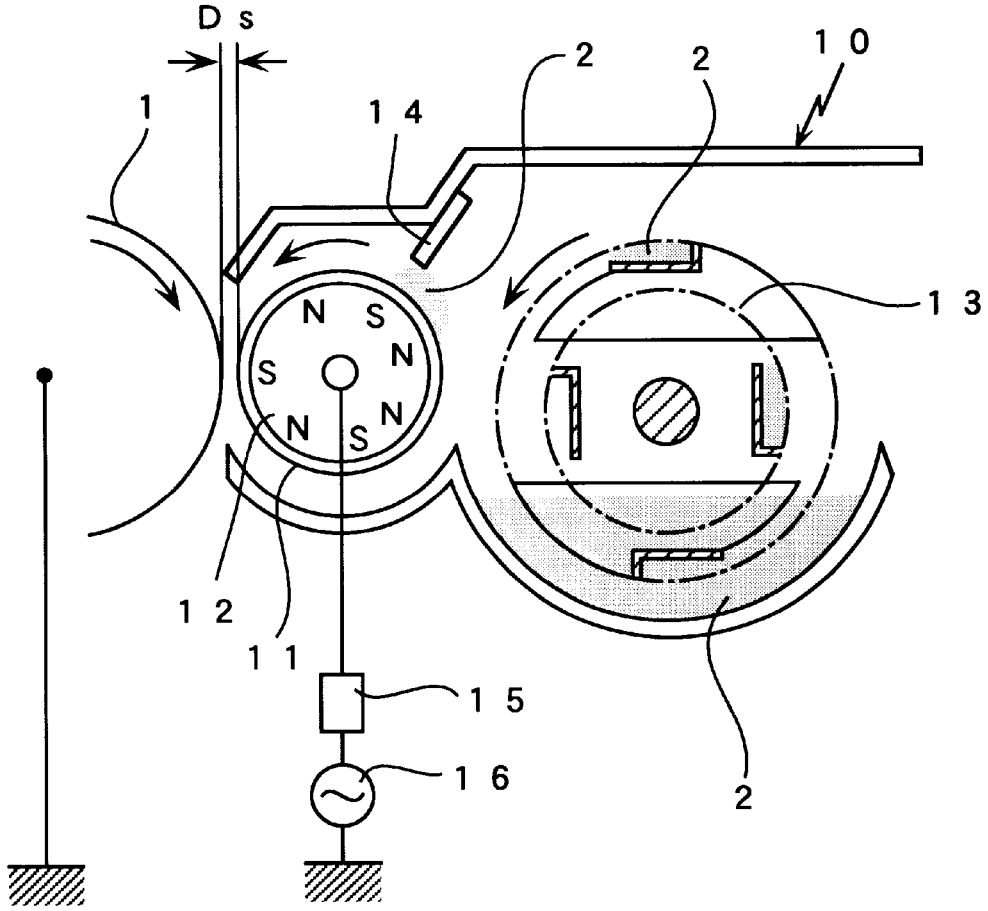
FIG. 1 is a schematic illustration of a developing apparatus used in a conventional example and an embodiment of the present invention.

The developing apparatus in the present embodiment uses a developer 2 containing toners and carriers, and the developer 2 is mixed and agitated by a developer agitating member 13 provided in the main body 10 of the apparatus, and is supplied to the surface of a cylindrical developer carrying member 11 provided opposite to an image carrying member 1, to hold the developer 2 in the surface of the developer carrying member 11 by a magnetic force of a magnet member 12 having a plurality of magnetic poles N, S, . . . provided on the side of the inner periphery of the developer carrying member 11, as in the conventional developing apparatus shown in FIG. 1.

The developer carrying member 11 is rotated, to convey the developer 2, and the amount of the developer 2 thus conveyed is adjusted by a regulating member 14, to convey the developer 2 in a suitable amount to a developing area opposite to the image carrying member 1 by the developer carrying member 11. A DC voltage is applied to the developer carrying member 11 from a DC power supply 15, and an AC voltage is applied thereto from an AC power supply 16, to exert an electric field which is an overlapping of a DC electric field and an AC electric field on the developing area where the developer carrying member 11 and the image carrying member 1 are opposite to each other. Toners in the developer 2 are supplied to an electrostatic latent image portion formed in the image carrying member 1 from the developer carrying member 11, to perform development.

In the developing apparatus in the present embodiment, in applying the AC voltage to the developer carrying member 11 from the AC power supply 16, the AC voltage is provided with two straight line portions A1 and A2 the respective voltage waveforms of which differ in slopes in a voltage change portion A where the AC voltage changes from a peak potential on the side of development (a first peak potential) V1 for supplying the developer 2 to the image carrying member 1 to a peak potential on the side of recovery (a second peak potential) V1' for returning the developer 2 to the developer carrying member 11 and/or two straight line portion B1 and B2 the respective voltage waveforms of which differ in slopes in a voltage change portion B where the AC voltage changes from the peak potential on the side of recovery (the second peak potential) V1' for returning the developer 2 to the developer carrying member 11 to the peak potential on the side of development (the first peak potential) V1 for supplying the developer 2 to the image carrying member 1, as shown in FIGS. 2 to 6.

When the AC voltage is applied to the developer carrying member 11, to supply the toners in the developer 2 to the electrostatic latent image portion formed in the image carrying member 1, the toners are sufficiently supplied to the electrostatic latent image portion in the image carrying member 11 from the developer carrying member 11. Accordingly, an image having a sufficient image density is obtained. Further, the toners in a suitable amount corresponding to a surface potential at the electrostatic latent image portion formed in the image carrying member 1 are satisfactorily supplied. Accordingly, the density of the image can be suitably controlled.

In the developing apparatus in the present embodiment, if the amount of the developer 2 to be conveyed to the developing area opposite to the image carrying member 1 by the developer carrying member 11 is too small, an image having a sufficient image density is not obtained. On the other hand, if the amount of the developer 2 to be conveyed to the developing area is too large, the toners in the developer 2 are scattered outward. Therefore, the amount of the developer 2 to be conveyed to the developing area is preferably in the range of 1 to 12 mg/cm$^2$, and more preferably in the range of 5 to 10 mg/cm$^2$.

In applying the AC voltage to the developer carrying member 11 from the AC power supply 16, when a peak-to-peak value Vpp of the AC voltage is too high, a leak is liable to occur between the developer carrying member 11 and the image carrying member 1. On the other hand, when the peak-to-peak value Vpp is too low, an image having a sufficient image density is not obtained. Therefore, the peak-to-peak value Vpp of the AC voltage is preferably in the range of 0.6 to 2.5 kV, and more preferably in the range of 1.0 to 1.8 kV.

When the frequency of the AC voltage applied to the developer carrying member 11 from the AC power supply 16 is not in a suitable range, an image having a fine texture and having a sufficient image density is not obtained. Therefore, the frequency of the AC voltage is preferably in the range of 1 to 9 kHz, and more preferably in the range of 2 to 7 kHz.

In the developing apparatus in the present embodiment, in applying the AC voltage from the AC power supply 16 to the developer carrying member 11, the AC voltage having the two straight line portions A1 and A2 the respective voltage waveforms of which differ in slopes and the two straight line portions B1 and B2 the respective voltage waveforms of which differ in slopes is continuously applied in the voltage change portion A where the AC voltage changes from the peak potential on the side of development for supplying the developer 2 to the image carrying member 1 to the peak potential on the side of recovery for returning the developer 2 to the developer carrying member 11 and the voltage change portion B where the AC voltage changes from the peak potential on the side of recovery for returning the developer 2 to the developer carrying member 11 to the peak potential on the side of development for supplying the developer 2 to the image carrying member 1. However, it is possible to use the AC voltage having the two straight line portions A1 and A2 and the two straight line portions B1 and B2 and the AC voltage having a normal rectangular wave in combination, or to provide a pause period during which the AC voltage is not exerted.

Although in the present embodiment, description was made of a developing apparatus using a two-component developer 2 containing toners and carriers, a developing apparatus using a mono-component developer containing only toners may be used.

The above-mentioned developing apparatus shown in FIG. 1 was carried on a conversion of a commercially available copying machine (CF900; manufactured by Minolta Co., Ltd.), and experiments were conducted by changing the type of AC voltage applied to the developer carrying member 11 from the AC power supply 16, to clarify by taking comparative examples that in the developing apparatus in the embodiment satisfying the conditions of the present invention, the developer 2 is sufficiently supplied to the electrostatic latent image portion formed in the image carrying member 1 from the developer carrying member 11, to obtain an image having a sufficient image density, and the developer 2 in an amount corresponding to the surface potential at the electrostatic latent image portion formed in the image carrying member 1 is satisfactorily supplied, to make it possible to suitably control the density of the image.

In the experiments, an example of the developer 2 was one having binder-type carriers each having an average particle diameter of approximately 35 $\mu$m and negatively charged toners each having an average particle diameter of approximately 8 $\mu$m mixed with each other such that the toner density would be 10% by weight. An example of the carrier used for the developer 2 was one generally having an average particle diameter in the range of 20 to 50 $\mu$m, and an example of the toner was one generally having a particle diameter in the range of 3 to 12 $\mu$m.

The system speed of the copying machine was set to 120 mm/sec., the ratio θ (=v2/v1) of the rotational speed v2 of the developer carrying member 11 to the rotational speed v1 of the image carrying member 1 was set to 2, the distance Ds between the developer carrying member 1 and the image carrying member was set to 0.3 mm, the amount of the developer 2 conveyed to the developing area by the developer carrying member 1 was set to 8 mg/cm$^2$, and an initial surface potential Vo at the image carrying member 1 was set to −500 V.

A DC voltage was applied to the developer carrying member 11 from the DC power supply 15, and an AC voltage was applied to the developer carrying member 11 from the AC power supply 16, to suitably adjust an area mean voltage value Vb between the DC voltage applied from the DC power supply 15 to the developer carrying member 11 and the AC voltage applied from the AC power supply 16.

EXAMPLES 1 TO 3 AND COMPARATIVE EXAMPLES 1 TO 3

In examples 1 to 3 and comparative examples 1 to 3, AC voltages having waveforms shown in FIGS. 2 to 7 are applied from the AC power supply 16 to the developer carrying member 11.

In any one of the AC voltages shown in FIGS. 2 to 7, a peak potential V1 on the side of development for supplying the developer 2 to the image carrying member 1 is −700 V, a peak potential V1' on the side of recovery for returning the developer 2 to the developer carrying member 11 is +700 V, a peak-to-peak value Vpp is 1.4 kV, and a time periods T1 during which the peak potential V1 on the side of development is exerted and a time period T1 during which the peak potential V1' on the side of recovery is exerted are respectively 0.166 msec.

Figure 2:
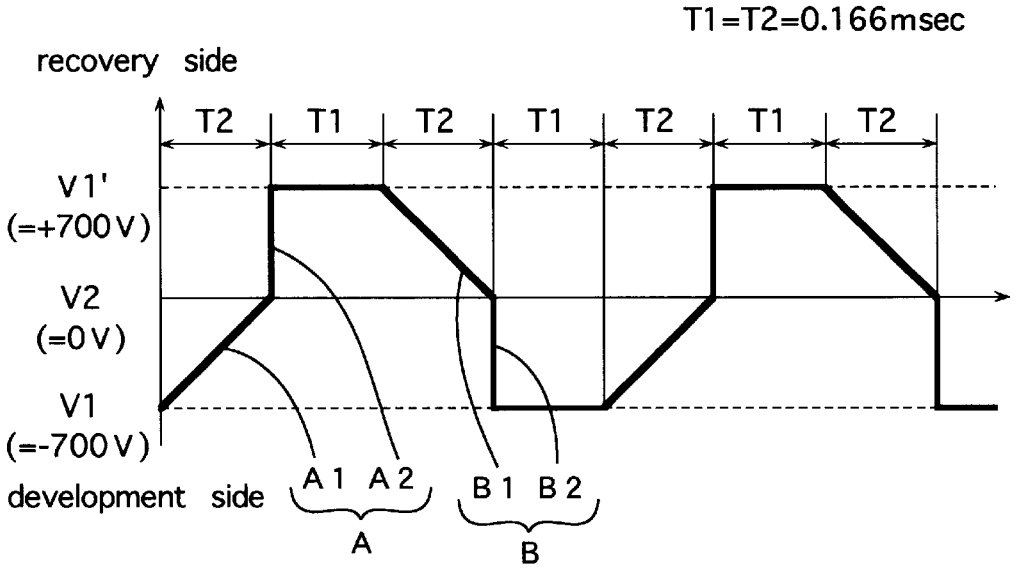
FIG. 2 is a diagram showing the waveform of an AC voltage applied to a developer carrying member from an AC power supply in an example 1.

In the example 1, an AC voltage is applied, as shown in FIG. 2. The AC voltage has two straight line portions A1 and A2 the respective voltage waveforms of which differ in slopes in a voltage change portion A where the AC voltage changes from the peak potential V1 on the side of development for supplying the developer 2 to the image carrying member 1 to the peak potential V1' on the side of recovery for returning the developer 2 to the developer carrying member 11, and also has two straight line portions B1 and B2 the respective voltage waveforms of which differ in slopes in a voltage change portion B where the AC voltage changes from the peak potential V1' on the side of recovery to the peak potential V1 on the side of development.

In the example 1, in the voltage change portion A where the AC voltage changes from the peak potential V1 on the side of development to the peak potential V1' on the side of recovery, a time period T2 in the first straight line portion A1 where the AC voltage changes from the peak potential V1 on the side of development to a potential V2 (=0 V) at which the slope of the voltage waveform changes is 0.166 msec. In the second straight line portion A2 where the AC voltage changes from the potential V2 to the peak potential V1' on the side of recovery, the potential V2 is changed to the peak potential V1' on the side of recovery at the time point where the AC voltage reaches 0 V. The peak potential V1' on the side of recovery is then exerted for 0.166 msec. Thereafter, in the voltage change portion B where the AC voltage changes from the peak potential V1' on the side of recovery to the peak potential V1 on the side of development, a time period T2 in the third straight line portion B1 where the AC voltage changes from the peak potential V1' on the side of recovery to the potential V2 (=0 V) at which the slope of the voltage waveform changes is 0.166 msec. In the fourth straight line portion B2 where the AC voltage changes from the potential V2 to the peak potential V1 on the side of development, the potential V2 is changed to the peak potential V1 on the side of development at the time point where the AC voltage reaches 0 V. The peak potential V1 on the side of development is then exerted for 0.166 msec. The foregoing is repeated. In the example 1, T2/T1=1, and |V1−V2|/Vpp=0.5. The conditions of $0.2 \leqq T2/T1 \leqq 3$ and $0.2 \leqq |V1-V2|/Vpp \leqq 0.9$ are satisfied.

Figure 3:
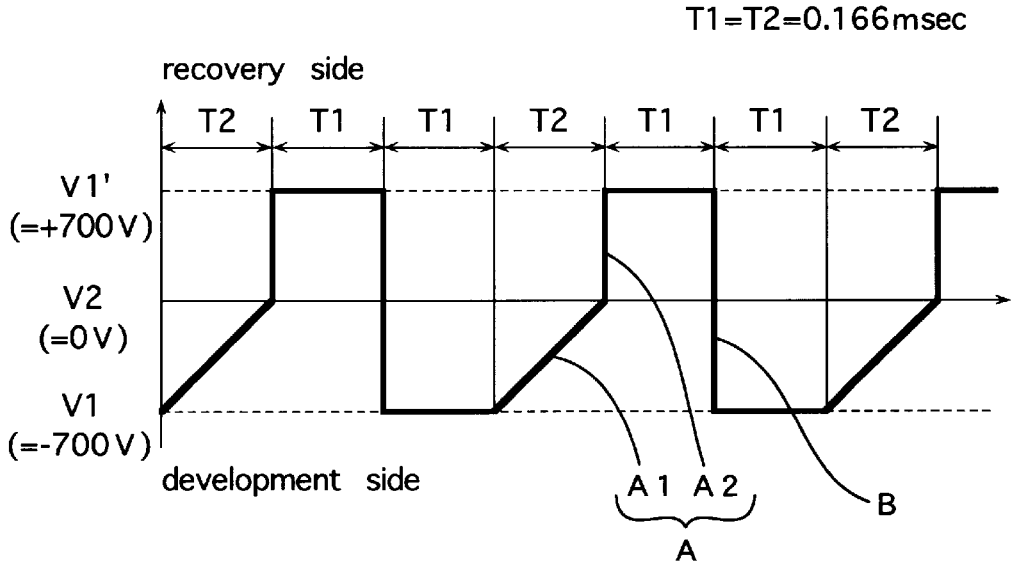
FIG. 3 is a diagram showing the waveform of an AC voltage applied to a developer carrying member from an AC power supply in an example 2.

In the example 2, an AC voltage is applied, as shown in FIG. 3. The AC voltage has two straight line portions A1 and A2 the respective voltage waveforms of which differ in slopes, as in the above-mentioned example 1, in a voltage change portion A where the AC voltage changes from the peak potential V1 on the side of development for supplying the developer 2 to the image carrying member 1 to the peak potential V1' on the side of recovery for returning the developer 2 to the developer carrying member 11, while immediately changing from the peak potential V1' on the side of recovery to the peak potential V1 on the side of development in a voltage change portion B where the AC voltage changes from the peak potential V1' on the side of recovery to the peak potential V1 on the side of development.

In the example 2, in the voltage change portion A where the AC voltage changes from the peak potential V1 on the side of development for supplying the developer 2 to the image carrying member 1 to the peak potential V1' on the side of recovery for returning the developer 2 to the developer carrying member 11, a time period T2 in the first straight line portion A1 where the AC voltage changes from the peak potential V1 on the side of development to a potential V2 (=0 V) at which the slope of the voltage waveform changes is 0.166 msec. In the second straight line portion A2 where the AC voltage changes from the potential V2 to the peak potential V1' on the side of recovery, the potential V2 is changed to the peak potential V1' on the side of recovery at the time point where the AC voltage reaches 0 V. The peak potential V1' on the side of recovery is then exerted for 0.166 msec. Thereafter, in the voltage change portion B where the AC voltage changes from the peak potential V1' on the side of recovery to the peak potential V1 on the side of development, the peak potential V1' on the side of recovery is immediately changed to the peak potential V1 on the side of development. In the example 2, T2/T1=1, and |V1−V2|/Vpp=0.5. The conditions of 0.2≦T2/T1≦3 and 0.2≦|V1−V2|/Vpp≦0.7 are satisfied.

Figure 4:
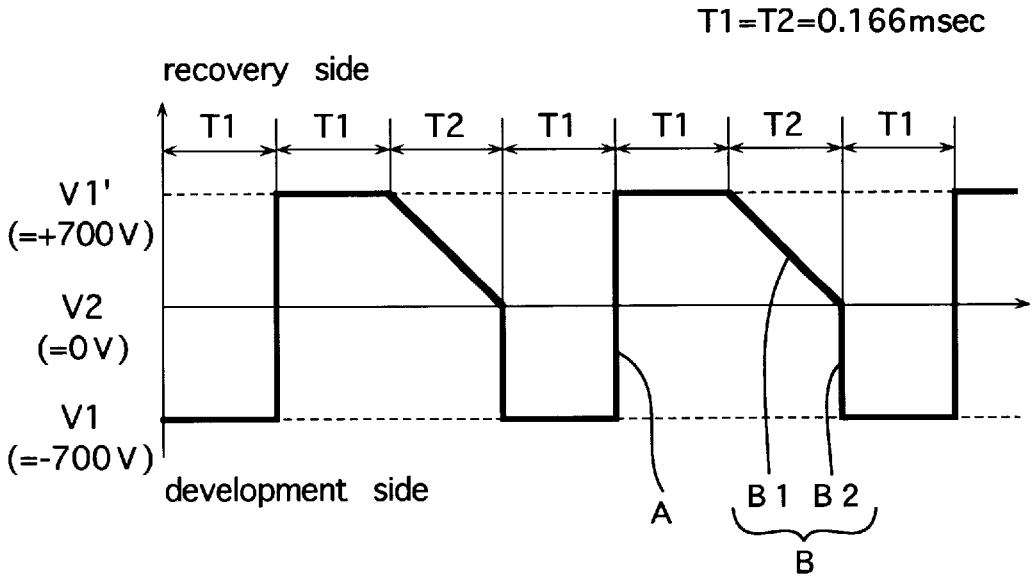
FIG. 4 is a diagram showing the waveform an AC voltage applied to a developer carrying member from an AC power supply in an example 3.

In the example 3, an AC voltage is applied, as shown in FIG. 4. The AC voltage has two straight line portions B1 and B2 the respective voltage waveforms of which differ in slopes, as in the above-mentioned example 1, in a voltage change portion B where the AC voltage changes from the peak potential V1' on the side of recovery to the peak potential V1 on the side of development, while immediately changing from the peak potential V1 on the side of development to the peak potential V1' on the side of recovery in a voltage change portion A where the AC voltage changes from the peak potential V1 on the side of development to the peak potential V1' on the side of recovery.

In the example 3, in the voltage change portion B where the AC voltage changes from the peak potential V1' on the side of recovery to the peak potential V1 on the side of development, a time period T2 in the third straight line portion B1 where the AC voltage changes from the peak potential V1' on the side of recovery to a potential V2 (=0 V) at which the slope of the voltage waveform changes is 0.166 msec. In the fourth straight line portion B4 where the AC voltage changes from the potential V2 to the peak potential V1 on the side of development, the potential V2 is changed to the peak potential V1 on the side of development at the time point where the AC voltage reaches 0 V. The peak potential V1 on the side of development is then exerted for 0.166 msec. Thereafter, in the voltage change portion A where the AC voltage changes from the peak potential V1 on the side of development to the peak potential V1' on the side of recovery, the peak potential V1 on the side of development is immediately changed to the peak potential V1' on the side of recovery. In the example 3, T2/T1=1, and |V1−V2|/Vpp=0.5. The conditions of 0.2≦T2/T1≦3 and 0.3≦|V1−V2|/Vpp≦0.7 are satisfied.

Figure 5:
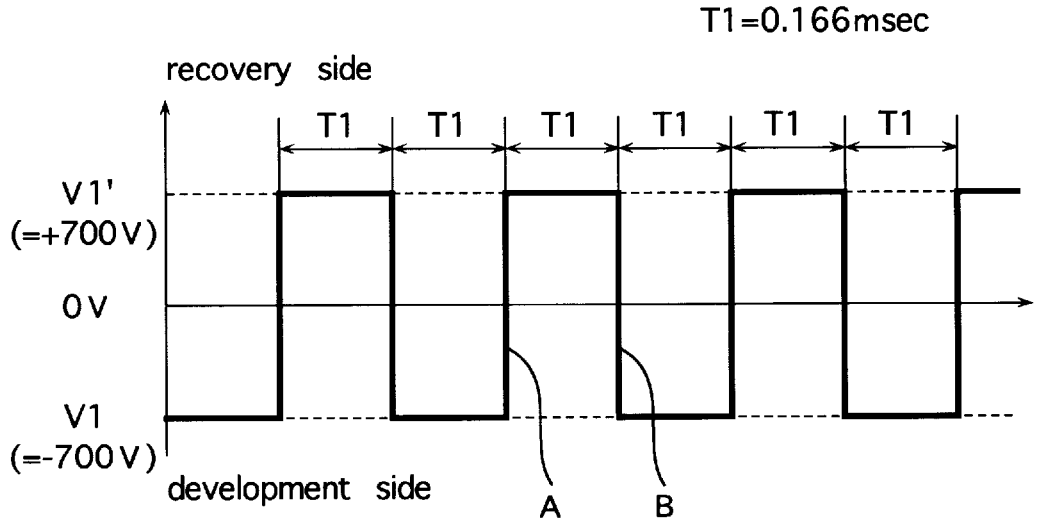
FIG. 5 is a diagram showing the waveform of an AC voltage applied to a developer carrying member from an AC power supply in a comparative example 1.

In the comparative example 1, in a voltage change portion A where the AC voltage changes from the peak potential V1 on the side of development to the peak potential V1' on the side of recovery and in a voltage change portion B where the AC voltage changes from the peak potential V1' on the side of recovery to the peak potential V1 on the side of development, an AC voltage having a rectangular wave which immediately changes from the peak potential to the other peak potential is applied, as shown in FIG. 5. In the AC voltage, a time period during which the peak potential V1 on the side of development is exerted and a time period during which the peak potential V1' on the side of recovery is exerted are respectively 0.166 msec.

Figure 6:
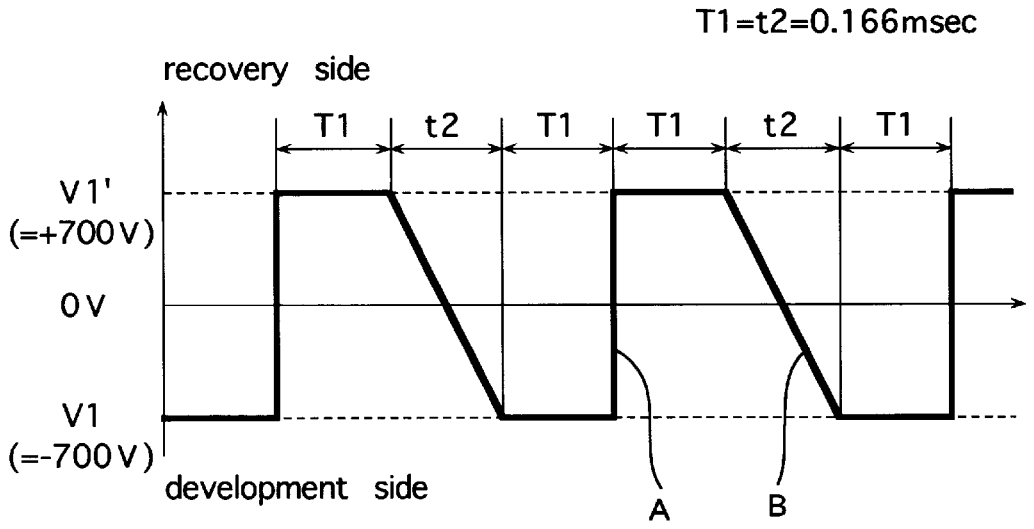
FIG. 6 is a diagram showing the waveform of an AC voltage applied to a developer carrying member from an AC power supply in a comparative example 2.

In the comparative example 2, an AC voltage is applied, as shown in FIG. 6. The AC voltage immediately changes from the peak potential V1 on the side of development to the peak potential V' on the side of recovery in a voltage change portion A where the AC voltage changes from the peak potential V1 on the side of development to the peak potential V1' on the side of recovery, while changing from the peak potential V1' on the side of recovery to the peak potential V1 on the side of development with a predetermined slope of the voltage waveform during a predetermined time period t2 (=0.166 msec.) in a voltage change portion B where the AC voltage changes from the peak potential V1' on the side of recovery to the peak potential V1 on the side of development.

Figure 7:
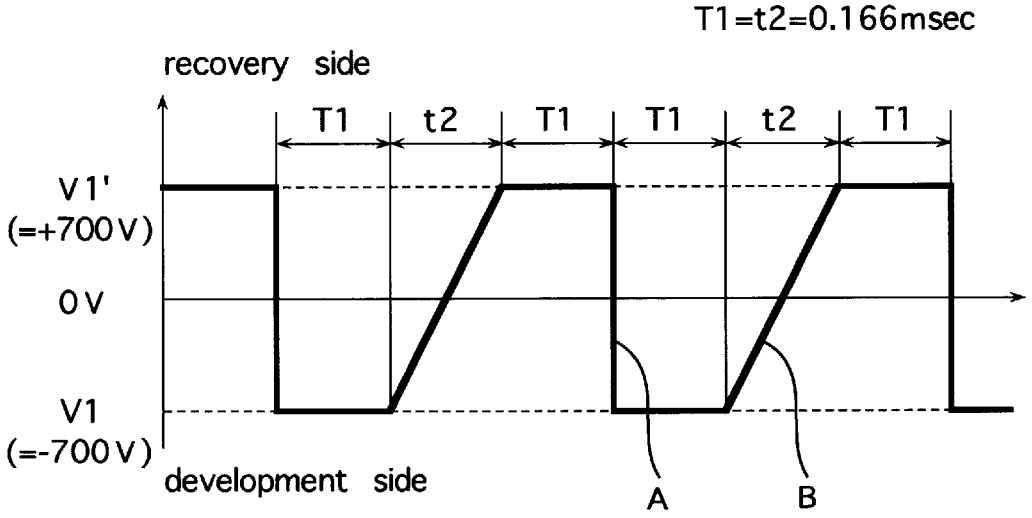
FIG. 7 is a diagram showing the waveform of an AC voltage applied to a developer carrying member from an AC power supply in a comparative example 3.

In the comparative example 3, an AC voltage is applied, as shown in FIG. 7. The AC voltage immediately changes from the peak potential V1' on the side of recovery to the peak potential V1 on the side of development in a voltage change portion A where the AC voltage changes from the peak potential V1' on the side of recovery to the peak potential V1 on the side of development, while changing from the peak potential V1 on the side of development to the peak potential V1' on the side of recovery with a predetermined slope of the voltage waveform during a predetermined time period t2 (=0.166 msec.) in a voltage change portion B where the AC voltage changes from the peak potential V1 on the side of development to the peak potential V1' on the side of recovery.

In the examples 1 to 3 and the comparative examples 1 to 3, a difference ΔV (=Vi−Vb) between an area mean voltage value Vb between the DC voltage applied from the DC power supply 15 to the developer carrying member 11 and the AC voltage applied from the AC power supply 16 and a surface potential Vi at the electrostatic latent image portion formed in the image carrying member was changed, to supply toners to the electrostatic latent image portion formed in the image carrying member 1 by reversal development, and measure the amount of toners adhering per unit area to the electrostatic latent image portion in the image carrying member 1.

At n points in a range in which the amount of adhering toners is 0.1 to 0.9 mg/cm$^2$, the value x of ΔV and the amount of adhering toners y per unit area were found, to find the slope of an approximate straight line representing the change in the amount of adhering toners relative to the change in ΔV, that is, γ representing developing characteristics by the following equation (1), and find a standard error α from the approximate straight line having the slope γ by the following equation (2). α was divided by γ, to find non-linearity representing variation from the approximate straight line. The results were shown in the following Table 1. The larger the value of γ representing developing characteristics is, the larger the increase in the amount of adhering toners by the increase of ΔV is. It is preferable that the value of γ is not less than 0.20. The smaller the value of the non-linearity is, the smaller the variation in the amount of adhering toners from the approximate straight line is. It is preferable that the value of the non-linearity is not more than 30.0.

$$\gamma = \frac{n\sum xy - (\sum x)(\sum y)}{n\sum x^2 - (\sum x)^2} \tag{1}$$

$$\alpha = \sqrt{\left[\frac{1}{n(n-2)}\right]\left[n\sum y^2 - (\sum y)^2 \frac{[n\sum xy - (\sum x)(\sum y)]^2}{n\sum x^2 - (\sum x)^2}\right]} \tag{2}$$

TABLE 1

| | example 1 | example 2 | example 3 | comparative example 1 | comparative example 2 | comparative example 3 |
|---|---|---|---|---|---|---|
| γ | 0.28 | 0.25 | 0.21 | 0.19 | 0.15 | 0.19 |
| non-linearity | 21.7 | 21.0 | 24.2 | 51.2 | 75.4 | 39.3 |

As a result of this, in the above-mentioned examples 1 to 3, the values of γ representing developing characteristics were larger, as compared with those in the comparative examples 1 to 3. Accordingly, an image having a sufficient image density was obtained. Further, the values of the non-linearity were lower. Accordingly, it was possible to also suitably adjust the density of the image.

EXPERIMENTAL EXAMPLE 1

In an experimental example 1, an AC voltage is applied, as in the above-mentioned example 1. The AC voltage has two straight line portions A1 and A2 the respective voltage waveforms of which differ in slopes in a voltage change portion A where the AC voltage changes from the peak potential V1 on the side of development for supplying the developer 2 to the image carrying member 1 to the peak potential V1' on the side of recovery for returning the developer 2 to the developer carrying member 11, and also has two straight line portions B1 and B2 the respective voltage waveforms of which differ in slopes in a voltage change portion B where the AC voltage changes from the peak potential V1' on the side of recovery to the peak potential V1 on the side of development.

In the experimental example 1, in the AC voltage shown in FIG. 2, a time period T2 in the first straight line portion A1 and the third straight line portion B1 the respective voltage waveforms of which have gentle slopes and a potential V2 at which the slope of the voltage waveform changes were changed, to change the values of T2/T1 and |V1−V2|/Vpp. Under the respective conditions, the value of γ representing developing characteristics and the value of non-linearity representing variation were found, as in the above-mentioned examples. The results were shown in the following Table 2.

TABLE 2 upper row: value of γ,
lower row: value of non-linearity

| \|V1-V2\|/ | T2/T1 | | | | | |
|---|---|---|---|---|---|---|
| Vpp | 0.1 | 0.2 | 0.3 | 1 | 3 | 4 |
| 0.9 | — | 0.20 | — | — | 0.20 | — |
| | — | 30.0 | — | — | 29.9 | — |
| 0.5 | 0.20 | — | 0.20 | 0.28 | 0.20 | 0.19 |
| | 36.0 | — | 29.0 | 21.7 | 23.1 | 25.6 |
| 0.2 | 0.19 | 0.20 | — | — | 0.20 | 0.17 |
| | 35.0 | 29.8 | — | — | 28.0 | 30.2 |

As a result of this, consider a case where the AC voltage having the two straight line portions A1 and A2 the respective voltage waveforms of which differ in slopes in the voltage change portion A where the AC voltage changes from the peak potential V1 on the side of development for supplying the developer 2 to the image carrying member 1 to the peak potential V1' on the side of recovery for returning the developer 2 to the developer carrying member 11, and also having the two straight line portions B1 and B2 the respective voltage waveforms of which differ in slopes in the voltage change portion B where the AC voltage changes from the peak potential V1' on the side of recovery to the peak potential V1 on the side of development is applied, as in the above-mentioned example 1. In this case, in a range in which the values of T2/T1 and |V1−V2|/Vpp satisfy the conditions of $0.2 \leqq T2/T1 \leqq 3$ and $0.2 \leqq |V1-V2|/Vpp \leqq 0.9$, the value of γ representing developing characteristics was a large value of not less than 0.20. Accordingly, an image having a sufficient image density was obtained. Further, the value of the non-linearity was a low value of not more than 30.0. Accordingly, it was possible to also suitably adjust the density of the image.

EXPERIMENTAL EXAMPLE 2

In an experimental example 2, an AC voltage is applied, as in the above-mentioned example 2. The AC voltage has two straight line portions A1 and A2 the respective voltage waveforms of which differ in slopes only in a voltage change portion A where the AC voltage changes from the peak potential V1 on the side of development for supplying the developer 2 to the image carrying member 1 to the peak potential V1' on the side of recovery for returning the developer 2 to the developer carrying member 11.

In the experimental example 2, in the AC voltage shown in FIG. 3, a time period T2 in the first straight line portion A1 whose voltage waveform has a gentle slope and a potential V2 at which the slope of the voltage waveform changes were changed, to change the values of T2/T1 and |V1−V2|/Vpp. Under the respective conditions, the value of γ representing developing characteristics and the value of non-linearity representing variation were found, as in the above-mentioned examples. The results were shown in the following Table 3.

TABLE 3 upper row: value of y,
lower row: value of non-linearity

| \|V1-V2\|/ | T2/T1 | | | | | | | |
|---|---|---|---|---|---|---|---|---|
| Vpp | 0.1 | 0.2 | 0.3 | 0.5 | 1 | 2 | 3 | 4 |
| 0.7 | — | 0.20 | — | — | 0.23 | — | 0.20 | 0.17 |
| | — | 29.9 | — | — | 28.5 | — | 28.8 | 34.0 |
| 0.5 | 0.20 | — | 0.22 | 0.23 | 0.25 | 0.23 | 0.21 | 0.19 |
| | 33.5 | — | 26.6 | 22.0 | 21.0 | 21.9 | 24.5 | 30.0 |
| 0.2 | — | 0.20 | — | — | 0.24 | — | 0.20 | 0.18 |
| | — | 29.7 | — | — | 26.6 | — | 27.7 | 30.9 |

As a result of this, consider a case where the AC voltage having the two straight line portions A1 and A2 the respective voltage waveforms of which differ in slopes is applied only in the voltage change portion A where the AC voltage changes from the peak potential V1 on the side of development for supplying the developer 2 to the image carrying member 1 to the peak potential V1' on the side of recovery for returning the developer 2 to the developer carrying member 11, as in the above-mentioned example 2. In this case, in a range in which the values of T2/T1 and |V1−V2|/Vpp satisfy the conditions of $0.2 \leqq T2/T1 \leqq 3$ and $0.2 \leqq |V1-V2|/Vpp \leqq 0.7$, the value of γ representing developing characteristics was a large value of not less than 0.20. Accordingly, an image having a sufficient image density was obtained. Further, the value of non-linearity was a low value of not more than 30.0. Accordingly, it was possible to also suitably adjust the density of the image.

EXPERIMENTAL EXAMPLE 3

In an experimental example 3, an AC voltage is applied, as in the above-mentioned example 3. The AC voltage has two straight line portions B1 and B2 the respective voltage waveforms of which differ in slopes only in a voltage change portion B where the AC voltage changes from the peak potential V1' on the side of recovery for returning the developer 2 to the developer carrying member 11 to the peak potential V1 on the side of development for supplying the developer 2 to the image carrying member 1.

In the experimental example 3, in the AC voltage shown in FIG. 4, a time period T2 in the third straight line portion B1 whose voltage waveform has a gentle slope and a potential V2 at which the slope of the voltage waveform changes were changed, to change the values of T2/T1 and |V1−V2|/Vpp. Under the respective conditions, the value of γ representing developing characteristics and the value of non-linearity representing variation were found. The results were shown in the following Table 4.

TABLE 4 upper row: value of y,
lower row: value of non-linearity

| \|V1-V2\|/ | T2/T1 | | | | | | |
|---|---|---|---|---|---|---|---|
| Vpp | 0.1 | 0.2 | 0.3 | 0.5 | 1 | 3 | 4 |
| 0.7 | — | 0.20 | — | — | 0.20 | 0.20 | 0.19 |
| | — | 29.8 | — | — | 30.0 | 29.9 | 31.9 |
| 0.5 | 0.20 | — | 0.20 | 0.20 | 0.21 | 0.20 | 0.19 |
| | 31.9 | — | 28.0 | 24.5 | 24.2 | 25.0 | 24.5 |
| 0.3 | — | 0.20 | — | — | 0.20 | 0.20 | 0.18 |
| | — | 29.1 | — | — | 27.0 | 26.6 | 28.8 |

As a result of this, consider a case where the AC voltage having the two straight line portions B1 and B2 the respective voltage waveforms of which differ in slopes is applied only in the voltage change portion B where the AC voltage changes from the peak potential V1' on the side of recovery for returning the developer 2 to the developer carrying member 11 to the peak potential V1 on the side of development for supplying the developer 2 to the image carrying member 1, as in the above-mentioned example 3. In this case, in a range in which the values of T2/T1 and |V1−V2|/Vpp satisfy the conditions of $0.2 \leqq T2/T1 \leqq 3$ and $0.3 \leqq |V1-V2|/Vpp \leqq 0.8$, the value of γ representing developing characteristics was a large value of not less than 0.20. Accordingly, an image having a sufficient image density was obtained. Further, the value of non-linearity was a low value of not more than 30.0. Accordingly, it was possible to also suitably adjust the density of the image.

EXAMPLES 4 TO 6

Figure 8:
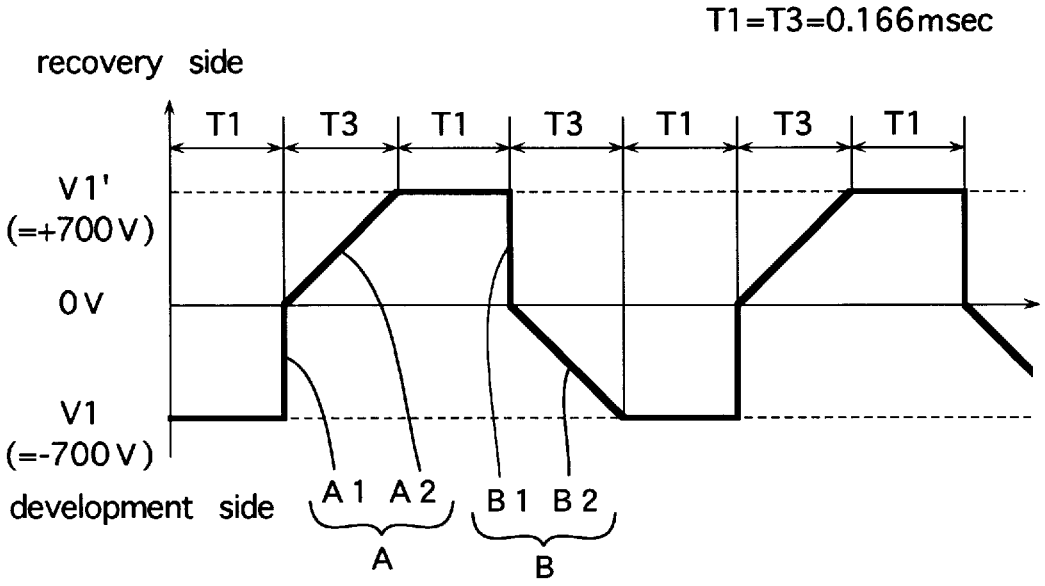
FIG. 8 is a diagram showing the waveform of an AC voltage applied to a developer carrying member from an AC power supply in an example 4.
Figure 9:
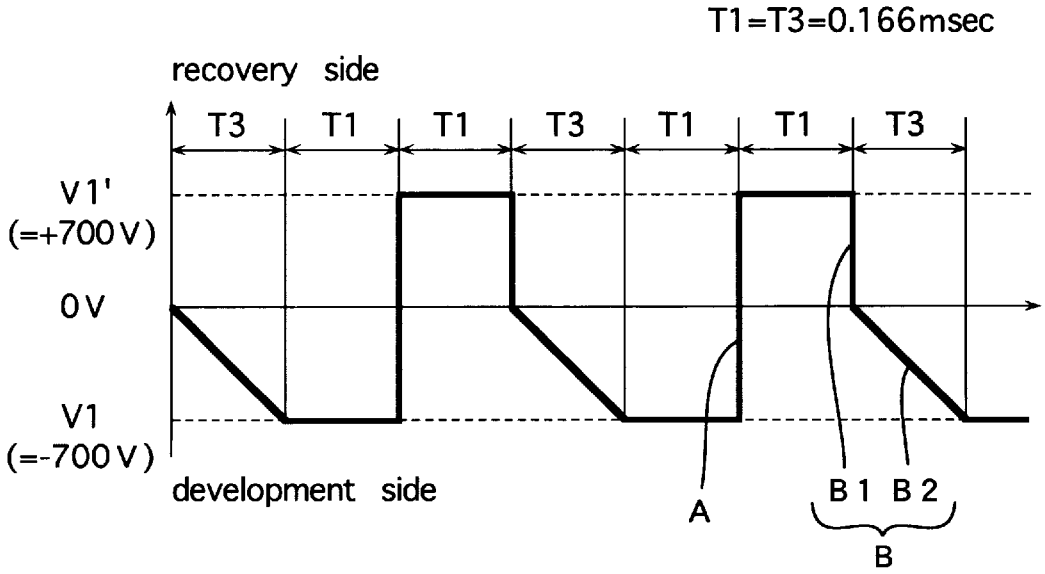
FIG. 9 is a diagram showing the waveform of an AC voltage applied to a developer carrying member from an AC power supply in an example 5.

In examples 4 to 6, AC voltages to be applied to the developer carrying member 11 from the AC power supply 16 are changed from the AC voltages in the examples 1 to 3 to AC voltages having waveforms shown in FIGS. 8 and 9.

In any one the AC voltages shown in FIGS. 8 and 9, a peak potential V1 on the side of development for supplying the developer 2 to the image carrying member 1 is −700 V, a peak potential V1' on the side of recovery for returning the developer to the developer carrying member 11 is +700 V, a peak-to-peak value Vpp is 1.4 kV, and a time period T1 during which the peak potential V1 on the side of development is exerted and a time period T1 during which the peak potential V1' on the side of recovery is exerted are respectively 0.166 msec.

In the example 4, an AC voltage is applied, as shown in FIG. 8. The AC voltage has two straight line portions A1 and A2 the respective voltage waveforms of which differ in slopes in a voltage change portion A where the AC voltage changes from the peak potential V1 on the side of development for supplying the developer 2 to the image carrying member 1 to the peak potential V1' on the side of recovery for returning the developer 2 to the developer carrying member 11, and also has two straight line portions B1 and B2 the respective voltage waveforms of which differ in slopes in a voltage change portion B where the AC voltage changes from the peak potential V1' on the side of recovery to the peak potential V1 on the side of development.

In the example 4, the peak potential V1 on the side of development is exerted for 0.166 msec. Thereafter, in the voltage change portion A where the AC voltage changes from the peak potential V1 on the side of development to the peak potential V1' on the side of recovery, the peak potential V1 on the side of development is immediately changed to a potential V2 (0 V) at which the slope of the voltage waveform changes in the first straight line portion A1 where the AC voltage changes from the peak potential V1 on the side of development to the potential V2 (=0 V) at which the slope of the voltage waveform changes. A time period T3 in the second straight line portion A2 where the AC voltage changes from the potential V2 (0 V) at which the slope of the voltage waveform changes to the peak potential V1' on the side of recovery is 0.166 msec. The peak potential V1' on the side of recovery is then exerted for 0.166 msec. Thereafter, in the voltage change portion B where the AC voltage changes from the peak potential V1' on the side of recovery to the peak potential V1 on the side of development, the peak potential V1' on the side of recovery is immediately changed to the potential V2 (0 V) at which the slope of the voltage waveform changes in the third straight line portion B1 where the AC voltage changes from the peak potential V1' on the side of recovery to the potential V2 (0 V) at which the slope of the voltage waveform changes. A time period T3 in the fourth straight line portion B2 where the AC voltage changes from the potential V2 (0 V) at which the slope of the voltage waveform changes to the peak potential V1 on the side of development is 0.166 msec.

In the example 5, an AC voltage is applied, as shown in FIG. 9. The AC voltage has two straight line portions B1 and B2 the respective voltage waveforms of which differ in slopes, as in the above-mentioned example 4, in a voltage change portion B where the AC voltage changes from the peak potential V1' on the side of recovery for returning the developer 2 to the image carrying member 1 to the peak potential V1 on the side of development for supplying the developer 2 to the image carrying member 1, while immediately changing from the peak potential V1 on the side of development to the peak potential V1' on the side of recovery in a voltage change portion A where the AC voltage changes from the peak potential V1 on the side of development to the peak potential V1' on the side of recovery.

In the example 5, the voltage change portion B where the AC voltage changes from the peak potential V1' on the side of recovery to the peak potential V1 on the side of development is the same as that in the above-mentioned example 4. In the third straight line portion B1 where the AC voltage changes from the peak potential V1' on the side of recovery to a potential V2 (0 V) at which the slope of the voltage waveform changes, the peak potential V1' on the side of recovery is immediately changed to the potential V2 (0 V) at which the slope of the voltage waveform changes. A time period T3 in the fourth straight line portion B2 where the AC voltage changes from the potential V2 (0 V) at which the slope of the voltage waveform changes to the peak potential V1 on the side of development is 0.166 msec. The peak potential V1 on the side of development is exerted for 0.166 msec. Thereafter, in the voltage change portion A where the AC voltage changes from the peak potential V1 on the side of development to the peak potential V1' on the side of recovery, the peak potential V1 on the side of development is immediately changed to the peak potential V1' on the side of recovery.

Figure 10:
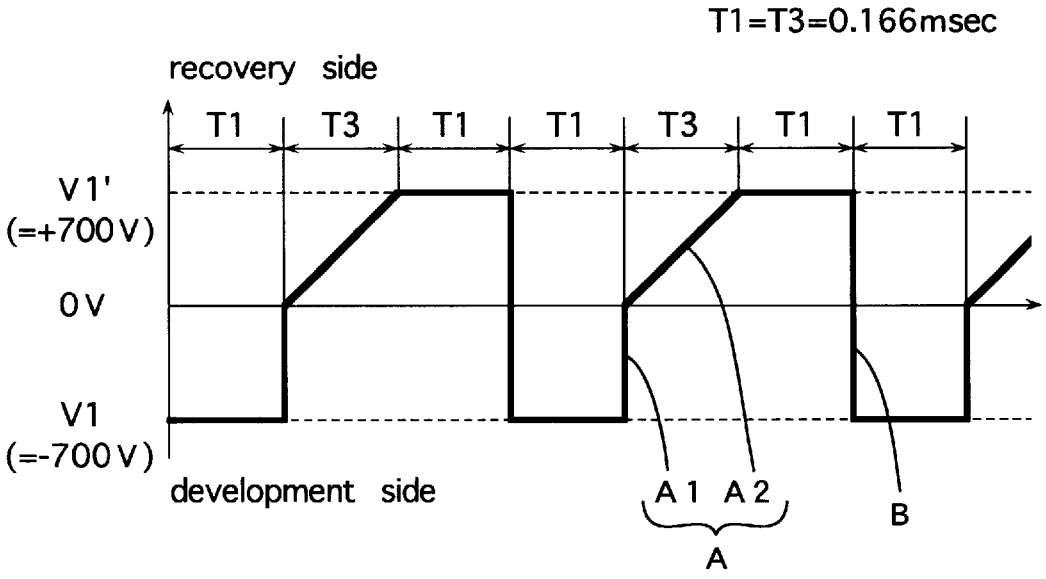
FIG. 10 is a diagram showing the waveform of an AC voltage applied to a developer carrying member from an AC power supply in an example 6.

In the example 6, an AC voltage is applied, as shown in FIG. 10. The AC voltage has two straight line portions A1 and A2 the respective voltage waveforms of which differ in slopes, as in the above-mentioned example 4, in a voltage change portion A where the AC voltage changes from a peak potential V1 on the side of development for supplying the developer 2 to the image carrying member 1 to a peak potential V1' on the side of recovery for returning the developer 2 to the developer carrying member 11, while immediately changing from the peak potential V1' on the side of recovery to the peak potential V1 on the side of development in a voltage change portion B where the AC voltage changes from the peak potential V1' on the side of recovery to the peak potential V1 on the side of development.

In the example 6, the voltage change portion A where the AC voltage changes from the peak potential V1 on the side of development to the peak potential V1' on the side of recovery is the same as that in the above-mentioned example 4. The peak potential V1 on the side of development is exerted for 0.166 msec. Thereafter, in the first straight line portion A1 where the AC voltage changes from the peak potential V1 on the side of development to a potential V2 (0 V) at which the slope of the voltage waveform changes, the peak potential V1 on the side of development is immediately changed to the potential V2 (0 V) at which the slope of the voltage change changes. A time period T3 in the second straight line portion A2 where the AC voltage changes from the potential V2 (0 V) at which the slope of the voltage waveform changes to the peak potential V1' on the side of recovery is 0.166 msec. The peak potential V1' on the side of recovery is exerted for 0.166 msec. Thereafter, in the voltage change portion B where the AC voltage changes from the peak potential V1' on the side of recovery to the peak potential V1 on the side of development, the peak potential V1' on the side of recovery is immediately changed to the peak potential V1 on the side of development.

Also in the examples 4 to 6, a difference $\Delta V$ (=Vi−Vb) between an area mean voltage value Vb between the DC voltage applied from the DC power supply 15 to the developer carrying member 11 and the AC voltage applied from the AC power supply 16 and a surface potential Vi at the electrostatic latent image portion formed in the image carrying member 1 was changed, as in the examples 1 to 3 and the comparative examples 1 to 3, to supply toners to the electrostatic latent image portion formed in the image carrying member 1 by reversal development, measure the amount of toners adhering per unit area to the electrostatic latent image portion in the image carrying member 1, and find the value of $\gamma$ representing developing characteristics and the value of non-linearity representing variation. The results, together with those in the comparative examples 1 to 3, were shown in the following Table 5.

Furthermore, in the examples 4 to 6 and the comparative examples 1 to 3, the value of $\Delta V$ was set to 300 V, to develop an electrostatic latent image formed in the image carrying member 1. The texture of a formed image was visually evaluated. The results were also shown in the following Table 5. The texture was evaluated as 5, 4, 3, 2, and 1, respectively, when it was very fine, was fine, was not practically a problem, was coarse, and was very coarse.

TABLE 5

| | example 4 | example 5 | example 6 | comparative example 1 | comparative example 2 | comparative example 3 |
|---|---|---|---|---|---|---|
| $\gamma$ | 0.21 | 0.20 | 0.25 | 0.19 | 0.15 | 0.19 |
| non-linearity | 21.7 | 22.2 | 26.7 | 51.2 | 75.4 | 39.3 |
| texture | 5 | 5 | 5 | 4 | 4 | 4 |

As a result of this, in the examples 4 to 6, the values of $\gamma$ representing developing characteristics were larger, as those in the above-mentioned examples 1 to 3, as compared with those in the comparative examples 1 to 3. Accordingly, an image having a sufficient image density was obtained. Further, the values of the non-linearity were lower. Accordingly, it was possible to also suitably adjust the density of the image. Furthermore, in the examples 4 to 6, the textures were more highly estimated, as compared with those in the comparative examples. Therefore, an image having a fine texture was obtained.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. A developing apparatus for developing an electrostatic latent image formed on an image carrying member, comprising:

a developer carrying member arranged opposite to the image carrying member and holding a developer; and a voltage applying device applying an AC voltage to said developer carrying member, wherein said AC voltage has a first peak potential and a second peak potential, the first peak potential being a peak potential on the side of development for supplying the developer to the image carrying member, the second peak potential being a peak potential on the side of recovery for returning the developer to the developer carrying member, a voltage waveform of said AC voltage comprising a first straight line portion and a second straight line portion while changing from said first peak potential to said second peak potential, the first straight line portion existing between the first peak potential and the second straight line portion, and a slope of the voltage waveform of said first straight line portion being gentler than a slope of the voltage waveform of said second straight line portion.

2. The developing apparatus according to claim 1, wherein said AC voltage changes from the first peak potential to the second peak potential through the first straight line portion and the second straight line portion.

3. The developing apparatus according to claim 2, wherein the slope of the voltage waveform of said first straight line portion is gentler than the slope of the voltage waveform of said second straight line portion.

4. The developing apparatus according to claim 3, wherein a time period during which said first peak potential is exerted and a time period during which said second peak potential is exerted are the same, and the time period T1 during which the first peak potential is exerted and a time period T2 in the first straight line portion satisfy the condition of $0.2 \leqq T2/T1 \leqq 3$.

5. The developing apparatus according to claim 3, wherein a time period during which said first peak potential is exerted and a time period during which said second peak potential is exerted are the same, and a peak-to-peak value Vpp of said AC voltage, a first peak potential V1, and a potential V2 at which the AC voltage changes from the first straight line portion to the second straight line portion satisfy the condition of $0.2 \leqq |V1-V2|/Vpp \leqq 0.7$.

6. The developing apparatus according to claim 1, wherein said AC voltage is substantially composed of only a straight line portion.

7. The developing apparatus according to claim 1, wherein an amount of the developer conveyed to a portion opposite to the image carrying member by said developer carrying member is in the range of 1 to 12 mg/cm$^2$.

8. The developing apparatus according to claim 1, wherein a peak-to-peak value Vpp of said AC voltage is 0.6 to 2.5 kV, and a frequency of the AC voltage is 1 to 9 kHz.

9. The developing apparatus according to claim 2, wherein the slope of the voltage waveform of said second straight line portion is gentler than the slope of the voltage waveform of said first straight line portion.

10. A developing apparatus for developing an electrostatic latent image formed on an image carrying member, comprising:

a developer carrying member arranged opposite to the image carrying member and holding a developer; and a voltage applying device applying an AC voltage to said developer carrying member, wherein said AC voltage has a first peak potential and a second peak potential, the first peak potential being a peak potential on the side of development for supplying the developer to the image carrying member, the second peak potential being a peak potential on the side of recovery for returning the developer to the developer carrying member, a voltage waveform of said AC voltage comprising a first portion while changing from said second peak potential to said first peak potential and a second portion while changing from said first peak potential to said second peak potential, the first portion consisting of only a first straight line portion and a second straight line portion, and the first straight line portion and the second straight line portion differing in slopes.

11. The developing apparatus according to claim 10, wherein said AC voltage changes from the second peak potential to the first peak potential through the first straight line portion and the second straight line portion.

12. The developing apparatus according to claim 11, wherein the slope of the voltage waveform of said first straight line portion is gentler than the slope of the voltage waveform of the second straight line portion.

13. The developing apparatus according to claim 12, wherein a time period during which said first peak potential is exerted and a time period during which said second peak potential is exerted are the same, and the time period T1 during which the first peak potential is exerted and a time period T2 in the first straight line portion satisfy the condition of $0.2 \leqq T2/T1 \leqq 3$.

14. The developing apparatus according to claim 12, wherein a time period during which said first peak potential is exerted and a time period during which said second peak potential is exerted are the same, and a peak-to-peak value Vpp of said AC voltage, a first peak potential V1, and a potential V2 at which the AC voltage changes from the first straight line portion to the second straight line portion satisfy the condition of $0.3 \leqq |V1-V2|/Vpp \leqq 0.8$.

15. The developing apparatus according to claim 10, wherein said AC voltage is substantially composed of only a straight line portion.

16. The developing apparatus according to claim 10, wherein an amount of the developer conveyed to a portion opposite to the image carrying member by said developer carrying member is in the range of 1 to 12 mg/cm$^2$.

17. The developing apparatus according to claim 10, wherein a peak-to-peak value Vpp of said AC voltage is 0.6 to 2.5 kV, and a frequency of the AC voltage is 1 to 9 kHz.

18. The developing apparatus according to claim 11, wherein the slope of the voltage waveform of said second straight line portion is gentler than the slope of the voltage waveform of the first straight line portion.

19. A developing apparatus for developing an electrostatic latent image formed on an image carrying member, comprising:

a developer carrying member arranged opposite to the image carrying member and holding a developer; and a voltage applying device applying an AC voltage to said developer carrying member, wherein said AC voltage has a first peak potential and a second peak potential, the first peak potential being a peak potential on the side of development for supplying the developer to the image carrying member, the second peak potential being a peak potential on the side of recovery for returning the developer to the developer carrying member, a voltage waveform of said AC voltage comprising a first straight line portion and a second straight line portion while changing from said first peak potential to said second peak potential, the first straight line portion and the second straight line portion differing in slopes, and said voltage waveform comprising a third straight line portion and a fourth straight line portion while changing from said second peak potential to said first peak potential, the third straight line portion and the fourth straight line portion differing in slopes.

20. The developing apparatus according to claim 19, wherein said AC voltage changes from the first peak potential to the second peak potential through the first straight line portion and the second straight line portion, and changes from the second peak potential to the first peak potential through the third straight line portion and the fourth straight line portion.

21. The developing apparatus according to claim 20, wherein the slope of the voltage waveform of said first straight line portion is gentler than the slope of the voltage waveform of the second straight line portion, and the slope of the voltage waveform of said third straight line portion is gentler than the slope of the voltage waveform of the fourth straight line portion.

22. The developing apparatus according to claim 21, wherein a time period during which said first peak potential is exerted and a time period during which said second peak potential is exerted are the same, and the time period T1 during which the first peak potential is exerted and a time period T2 in the first straight line portion satisfy the condition of $0.2 \leqq T2/T1 \leqq 3$.

23. The developing apparatus according to claim 21, wherein a time period during which said first peak potential is exerted and the time period during which said second peak potential is exerted are the same, and a peak-to-peak value Vpp of said AC voltage, a first peak potential V1, and a potential V2 at which the AC voltage changes from the first straight line portion to the second straight line portion satisfy the condition of $0.2 \leqq |V1-V2|/Vpp \leqq 0.9$.

24. The developing apparatus according to claim 19, wherein said AC voltage is substantially composed of only a straight line portion.

25. The developing apparatus according to claim 20, wherein the slope of the voltage waveform of said second straight line portion is gentler than the slope of the voltage waveform of the first straight line portion, and the slope of the voltage waveform of said fourth straight line portion is gentler than the slope of the voltage waveform of the third straight line portion.

* * * * *